US007984906B2

(12) United States Patent
Yoneyama et al.

(10) Patent No.: US 7,984,906 B2
(45) Date of Patent: Jul. 26, 2011

(54) MEDIUM DETECTION METHOD AND A MEDIUM PROCESSING DEVICE

(75) Inventors: Yuichi Yoneyama, Nagano-ken (JP); Tomoaki Kimura, Nagano-ken (JP); Atsushi Natsuno, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 91 days.

(21) Appl. No.: 12/503,534

(22) Filed: Jul. 15, 2009

(65) Prior Publication Data

US 2010/0019445 A1 Jan. 28, 2010

(30) Foreign Application Priority Data

Jul. 23, 2008 (JP) ..... 2008-189462

(51) Int. Cl.
*B65H 7/02* (2006.01)

(52) U.S. Cl. ..... 271/265.02; 271/265.04; 194/334; 194/335

(58) Field of Classification Search ..... 271/265.02, 271/227, 265.04, 265.01, 262; 209/534; 194/334, 335
See application file for complete search history.

(56) References Cited

U.S. PATENT DOCUMENTS

| | | | | |
|---|---|---|---|---|
| 6,062,369 | A * | 5/2000 | Negishi | 194/207 |
| 6,351,551 | B1 * | 2/2002 | Munro et al. | 382/135 |
| 6,782,986 | B2 * | 8/2004 | Toda et al. | 194/206 |
| 7,016,767 | B2 * | 3/2006 | Jones et al. | 700/224 |
| 7,103,206 | B2 * | 9/2006 | Graves et al. | 382/135 |
| 7,103,438 | B2 * | 9/2006 | Hallowell et al. | 700/116 |
| 7,131,539 | B2 * | 11/2006 | Mukai | 209/534 |
| 7,306,216 | B2 * | 12/2007 | Lee et al. | 271/10.01 |
| 7,688,475 | B2 * | 3/2010 | Yoo et al. | 358/403 |
| 7,694,964 | B2 * | 4/2010 | Kawasaki et al. | 271/263 |
| 7,780,163 | B2 * | 8/2010 | Schinzel-Reiner et al. | 271/227 |
| 7,792,479 | B2 * | 9/2010 | Yasumoto | 399/388 |
| 2002/0008138 | A1 * | 1/2002 | Yamauchi et al. | 235/379 |
| 2003/0141653 | A1 * | 7/2003 | Kumamoto et al. | 271/262 |
| 2004/0124575 | A1 * | 7/2004 | Lee et al. | 271/10.01 |
| 2007/0000819 | A1 * | 1/2007 | Yui | 209/534 |
| 2008/0099560 | A1 | 5/2008 | Fujikawa et al. | |
| 2008/0122166 | A1 * | 5/2008 | Fukube | 271/265.01 |
| 2008/0210605 | A1 * | 9/2008 | Park et al. | 209/534 |
| 2009/0051109 | A1 * | 2/2009 | Hiroike et al. | 271/265.01 |

FOREIGN PATENT DOCUMENTS

| | | |
|---|---|---|
| JP | 05-258146 | 10/1993 |
| JP | 06-009105 | 1/1994 |
| JP | 06-183601 | 7/1994 |
| JP | 07-061650 | 3/1995 |
| JP | 07-061651 | 3/1995 |
| JP | 2002-326409 | 11/2002 |
| JP | 2004-206362 | 7/2004 |
| JP | 2005-225661 | 8/2005 |
| JP | 2008-117040 | 5/2008 |

* cited by examiner

*Primary Examiner* — Kaitlin S Joerger

(57) ABSTRACT

Using detectors, skewed conveyance of sheet media such as checks can be detected accurately regardless of whether part of the conveyed medium is folded over. The biased feed detection unit 33 of a check processing device 1 according to at least one embodiment of the invention determines the lengths L1 and L2 of the conveyed check 6 (ST31 and ST32) and the thickness of a folded part of the check 6 (ST33) at different positions perpendicular to the transportation direction based on the output of a paper thickness detector 25 and a length detector 26 disposed to the check transportation path 7. The folded length L3 is then subtracted from the difference ΔL of the detected lengths to acquire a corrected difference ΔL1 (ST35). If the corrected difference ΔL1 is less than or equal to a threshold value D, the medium is determined to be conveyed normally (ST37). If the corrected difference ΔL1 exceeds the threshold value D, the medium is determined to be skewed (ST38). Skewed conveyance of the check 6 can thus be accurately determined.

17 Claims, 8 Drawing Sheets

MEDIUM DETECTION METHOD AND A MEDIUM PROCESSING DEVICE

CROSS-REFERENCE TO RELATED APPLICATIONS

Japanese Patent application No. 2008-189462 is hereby incorporated by reference in its entirety.

BACKGROUND

1. Field of Invention

The present invention relates to a medium detection method and a medium processing device that determine if the medium is skewed as it is conveyed through the transportation path in a medium processing device that processes while conveying media such as checks through a transportation path.

2. Description of the Related Art

In banks and other financial institutions, checks, promissory notes, and other check-like negotiable instruments (collectively referred to as "checks" herein) submitted for payment or processing are loaded into a check reading device to capture images of the front and back and read the magnetic ink character line. As electronic processing of such instruments has become more common, the captured image data and magnetic ink character data is processed by computer, and the check information is managed by computer.

A typical check processing device reads the magnetic ink character line and captures images of the front and back of each check as the checks are conveyed horizontally standing on edge through a transportation path that is a narrow vertical channel open to the top passed a magnetic head and image sensors (image scanning heads). The downstream end of the transportation path is connected to a first storage pocket (first discharge unit) and a second storage pocket (second discharge unit). Checks from which the magnetic ink character line is read normally are discharged into the first storage pocket, and all other checks are discharged into the second storage pocket. Checks that are discharged into the second storage pocket are conveyed and processed again. A check processing device of this type is taught in Japanese Unexamined Patent Appl. Pub. JP-A-2004-206362.

When checks are multifed, or when a check is fed with the top and bottom or front and back reversed, in a check processing device, the magnetic ink character line cannot be read or read errors occur. To detect such transportation errors, Japanese Unexamined Patent Appl. Pub. JP-A-2005-225661 teaches a check processing device that has a detection unit to detect multifeed states in which two or more checks are simultaneously conveyed overlapping, and Japanese Unexamined Patent Appl. Pub. JP-A-2008-117040 teaches a check processing device having a detection unit to detect when a check is conveyed with the top and bottom inverted or the front and back reversed.

If a check is conveyed in a skewed state at a great angle of inclination to the transportation path, the check is conveyed with the printing position of the magnetic ink character line removed from the reading position of the magnetic head, and the magnetic ink characters either cannot be read or read errors occur. In order to detect if a check is conveyed in a skewed position, the timing when the paper medium passes the respective detection positions may be detected by a pair of photosensors that are separated perpendicularly to the transportation direction detect, and a skewed feed state may be detected when there is a great difference in the timing when the medium passes the sensor pairs as taught in Japanese Unexamined Patent Appl. Pub. JP-A-H06-9105.

When skewed transportation of the check medium is detected using the method taught in Japanese Unexamined Patent Appl. Pub. JP-A-H06-9105, the following problems can occur.

The edges or corners of the check may become folded and creased while in the possession of the user, such as when the check is inserted to the user's wallet or coat pocket. If the check is then loaded into the check processing device, the check may be conveyed folded over along the crease. If the check is conveyed with one side at the leading end in the transportation direction folded over, the timing when the one sensor disposed to the position where this folded part passes detects the check will be delayed from the timing when the other sensor detects the check. If this delay is great, a skewed transportation condition may be detected even though the check is conveyed in a normal unskewed condition. It is also conceivable to detect the length of the passing check by means of these sensors and detect if the check is skewed based on the difference in the detected lengths. However, if one of the ends is folded over, the detected lengths will be accordingly different, and detection errors may result. More specifically, the detected length will be short by the amount that the check is folded over.

SUMMARY OF INVENTION

A medium detection method and a medium processing device according to at least one embodiment of the present invention use a detector to enable detecting skewed transportation of the medium with good precision even when the check or other medium has a part that is folded over.

A medium detection method according to a first aspect of the present invention has steps including conveying a medium along a transportation path; detecting, at a first position on the transportation path, a first length in the transportation direction of the medium passing the first position; detecting, at a second position that is separated a specific distance from the first position on the transportation path, a second length in the transportation direction of the medium passing the second position; detecting, at a third position on the transportation path, a thickness of the medium passing the third position; and determining if the medium is being conveyed skewed to the transportation direction based on the first length, the second length, and the thickness.

The medium detection method according to another aspect of the invention has steps of: calculating the difference between the first length detected at the first position and the second length detected at the second position; calculating a folded length of the medium based on change in the thickness detected at the third position; calculating a corrected difference by subtracting the folded length from the calculated difference; and determining that the medium is skewed to the transportation direction if the corrected difference exceeds a predetermined threshold value.

The medium detection method according to another preferred aspect of the invention has steps of: calculating the difference between the first length and the second length; calculating a folded length of the medium based on change in the thickness detected at the third position; calculating a corrected difference by subtracting the folded length from the first calculated difference; and determining that the medium is not skewed to the transportation direction if the corrected difference is less than or equal to a predetermined threshold value.

Preferably, the medium is determined to be conveyed skewed at an angle exceeding an allowable skew angle to the transportation direction if the corrected difference exceeds the threshold value.

Preferably, the medium is determined to be at an angle less than or equal to an allowable skew angle to the transportation direction and the medium is not conveyed skewed if the corrected difference is less than or equal to the threshold value.

In a medium detection method according to another aspect of the invention the transportation path includes a channel; and the first position is disposed to a position closer to the bottom of the channel than the second position.

Because the medium is conveyed in a vertical posture along the bottom of a transportation path that is vertical channel, parts of the medium at a constant height from the bottom of the transportation path pass the first position and the second position. When the medium is conveyed in a normal position with little or no skew (a position in which the slope of the medium is within an allowable skew angle to the transportation direction), the difference of the lengths detected at a first position and a second position that are separated a specific distance on the transportation path will be substantially equal. For example, when a rectangular medium is conveyed along the edge surface of a transportation guide, both detected lengths will be substantially equal and the difference therebetween will be substantially zero.

When the medium is conveyed in a skewed position (a position in which the slope of the medium to the transportation direction exceeds an allowable skew angle), either the leading end or the trailing end of the medium in the transportation direction will be elevated from the bottom of the vertical channel of the transportation path. As a result, the length in the transportation direction of the medium will change at the parts passing the first position and the second position, and a difference will result. If the medium is rectangular, the first length detected at a point passing the first position near the bottom of the vertical channel will be shorter. Whether the medium is conveyed in a skewed position can therefore be determined based on the difference between both lengths.

In addition, if the leading part or the trailing part of the medium in the transportation direction is folded over, the detected length will be shorter by the length of the folded portion when the folded portion passes the first position or the second position. As a result, the difference between the detected lengths increases even though the medium is conveyed in a normal posture, and skewed transportation of the medium may be erroneously detected. However, a preferred aspect of the invention detects the thickness of the medium passing a third position. Because the thickness of the folded part will be twice the normal thickness when the medium is folded over at the leading end in the transportation direction, the length of the folded portion in the transportation direction can be detected when the folded portion passes the first position and the second position. If the difference of the lengths at the first position and the second position is large, the length difference caused by this folded part can be eliminated or reduced by subtracting the length of the folded part from this difference.

The possibility of falsely detecting a skewed position even though the medium is conveyed in a normal position due to part of the medium being folded over can be reduced and detection accuracy can be improved.

Further preferably, the third position and either one of the first position and the second position are substantially the same position. Because this aspect of the invention detects both one length and the thickness at the same position, length differences caused by a folded portion can be more accurately eliminated or reduced.

The medium detection method according to at least one embodiment of the present invention is applicable for use detecting skewed conveyance of rectangular media of a constant thickness, such as checks on which magnetic ink characters are printed.

When the medium is a check printed with magnetic ink characters, for example, the magnetic ink characters and an image of the medium conveyed through the transportation path can be read using a magnetic head, image sensor, or other reading device disposed to the transportation path for reading information from the medium.

In order to convey media such as checks of different sizes, the transportation path may be a vertical channel that is open at the top for conveying the media standing on edge. In this configuration the first position is disposed closer to the bottom of the vertical channel than the second position.

Further preferably, media that are determined to not be skewed while conveyed are discharged from the transportation path into a first discharge unit; and media that are determined to be skewed while conveyed are discharged from the transportation path into a second discharge unit.

In a processing device that reads information from the check or other medium while conveying the medium through the transportation path, the information cannot be read or read errors occur when the medium is skewed and the medium must therefore be conveyed and read again. It is convenient in such situations to discharge the skewed media to a separate discharge unit.

Another aspect of the invention is a medium processing device that has a transportation path for conveying media; a first detector and a second detector that detect the length in the transportation direction of the medium, and are disposed to positions that are mutually separated a specific distance on the transportation path; a thickness detector that detects the thickness in the transportation direction of the medium and is disposed to the transportation path; and a control unit that determines if the medium is conveyed skewed to the transportation direction based on a first length detected by the first detector, a second length detected by the second detector, and the thickness detected by the thickness detector.

In according to another aspect of the invention the medium processing device the control unit calculates the difference between the first length and the second length, calculates a folded length of the medium based on change in the detected thickness detected by the thickness detector, calculates a corrected difference by subtracting the folded length from the calculated difference, and determines that the medium is skewed to the transportation direction if the corrected difference exceeds a predetermined threshold value.

Preferably, the control unit calculates the difference between the first length and the second length, calculates a folded length of the medium based on change in the detected thickness detected by the thickness detector, calculates a corrected difference by subtracting the folded length from the calculated difference, and determines that the medium is not skewed to the transportation direction if the corrected difference is less than or equal to a predetermined threshold value.

Preferably, the control unit determines that the medium is conveyed skewed at an angle exceeding an allowable skew angle to the transportation direction if the corrected difference exceeds the threshold value.

Preferably, the control unit determines that the medium is at an angle less than or equal to an allowable skew angle to the transportation direction and the medium is not conveyed skewed if the corrected difference is less than or equal to the threshold value.

When the conveyed medium is folded over, the skew detection unit of the medium processing device according to this aspect of the invention takes this folded part into consideration when determining if the medium is conveyed in a skewed position (that is, determining if the medium is conveyed at an angle to the transportation direction that is less than or equal to an allowable skew angle or an angle exceeding this allowable skew angle). As a result, erroneously determining because of a folded portion that the medium is skewed even though the medium is not skewed (is conveyed in a normal position) is prevented.

Further preferably, the transportation path includes a channel; and the first detector is disposed to a position closer to the bottom of the channel than the detection position of the second detector.

When the medium is rectangular, the length of the part of the medium passing the first position closer to the bottom of the vertical channel will be shorter than the length detected at the second position if the medium is skewed or folded over. Whether the medium is skewed or not can therefore be determined based on the difference in the detected lengths.

Preferably, either the first detector or the second detector also functions as a thickness detector.

Because the length and thickness are detected at the same position, differences in length due to a folded portion can be more accurately eliminated or reduced even if the folded part is a corner of the medium.

Yet further preferably, the medium processing device also has a first discharge unit and a second discharge unit in which media are discharged at the downstream side of the transportation path; and a sorting unit that switches so that the medium is discharged into the first discharge unit when the control unit determines that the medium is not skewed, and the medium is discharged into the second discharge unit when the control unit determines that the medium is skewed.

Because the magnetic head, scanner, or other reading device that is disposed to the transportation path to read information from the medium often cannot read skewed media or produce read errors when the medium is skewed, the medium must be conveyed and read again. Separating the skewed media in this situation is therefore convenient.

Yet further preferably, the thickness detector of the medium processing device has a detection lever that is pressed to the reading device with the medium therebetween and moves in a direction toward or away from the reading device according to the thickness of the intervening medium, and a detector that detects movement of the detection lever.

Effect of at Least One Embodiment of the Invention

The medium detection method and medium processing device according to at least one embodiment of the present invention have first and second positions (first and second detectors) for detecting media that are conveyed in a skewed position and detect the length and thickness of the medium at at least a first position (first detector) that is closer to the bottom of a vertical channel. The folded length of a folded portion at the part of the medium passing the first position is detected based on the change in thickness, and error contained in the difference of the lengths caused by a folded part during skew detection is reduced or eliminated. The effect of folded parts of the medium can thus be suppressed, and skew can be detected with good accuracy.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of a medium processing device according to at least one embodiment of the present invention is described below with reference to the accompanying figures.

General Configuration

Figure 1:
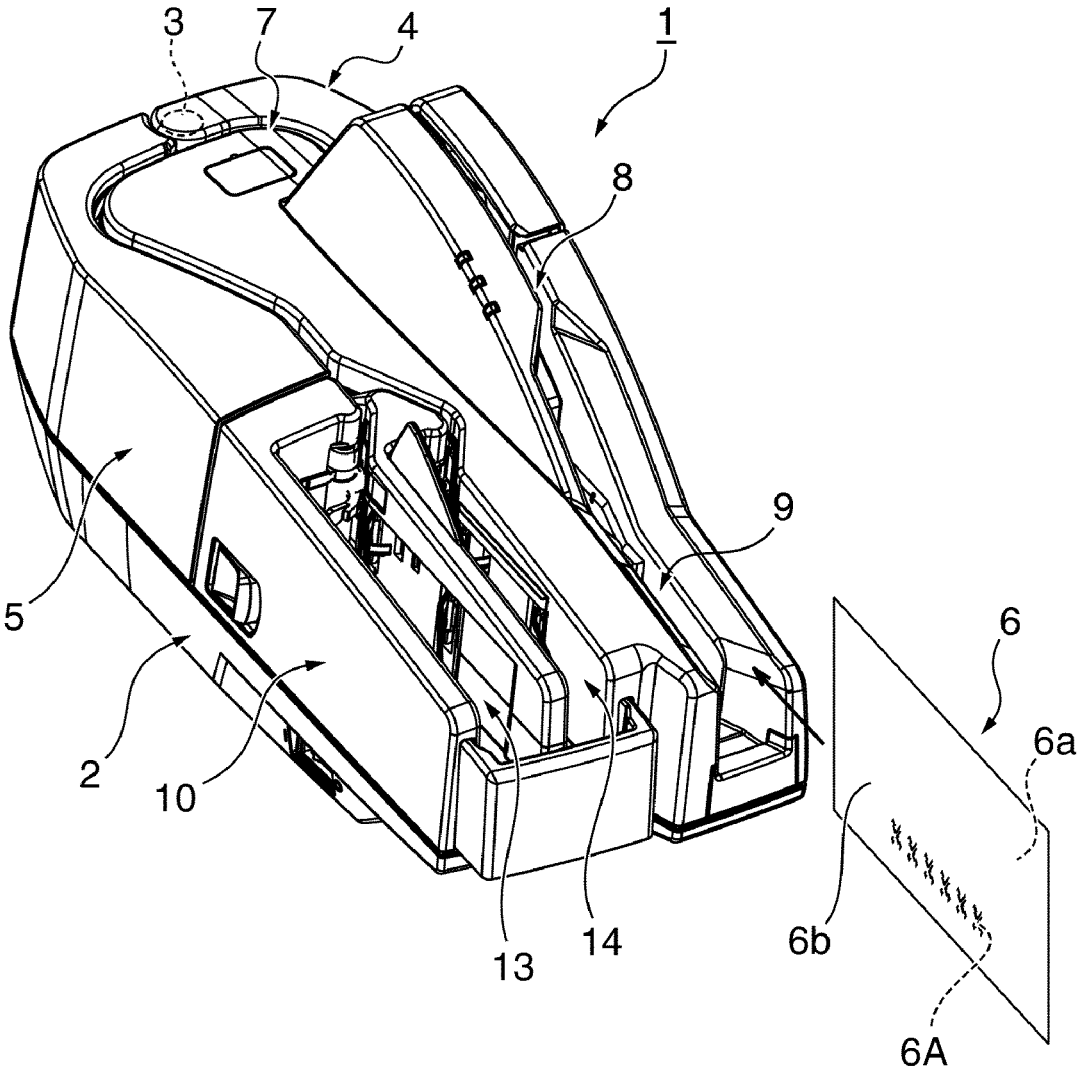
FIG. 1 is an oblique view of a check processing device according to at least one embodiment of the present invention.
Figure 2:
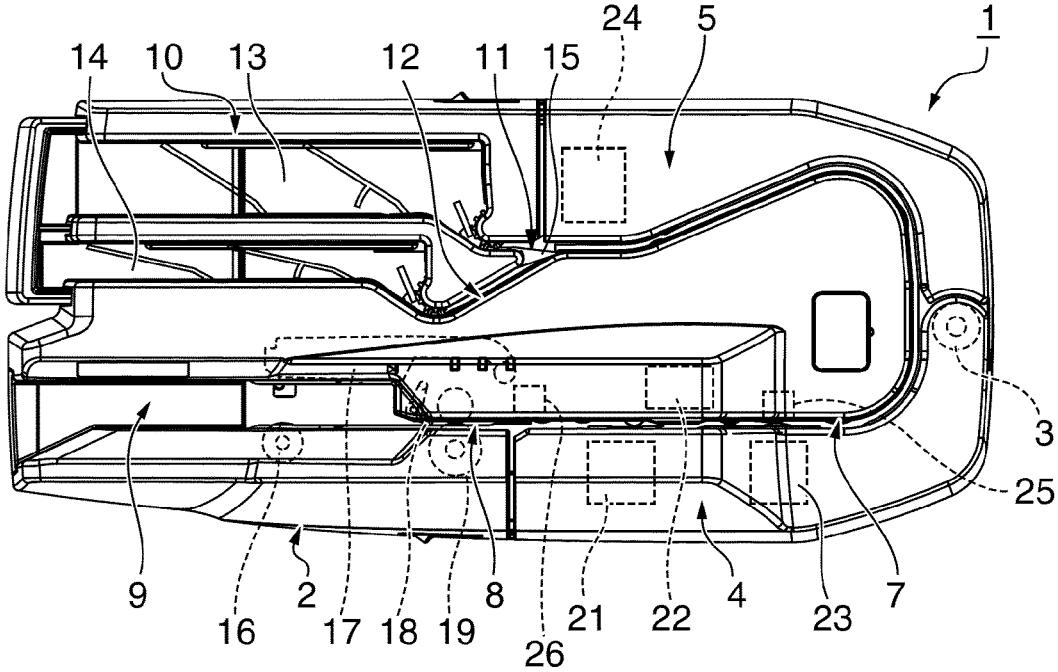
FIG. 2 is a plan view of the check processing device shown in FIG. 1.

FIG. 1 and FIG. 2 are an oblique view and a plan view of a check processing device as an example of a medium processing device according to a preferred embodiment of the invention.

The check processing device 1 has a case 2 on the main unit side and a pair of left and right access covers 4 and 5 that open and close pivoting on a vertical support pin 3 disposed at the back end of the case 2. A check transportation path 7 for conveying checks 6 is formed between the case 2 and the access covers 4 and 5.

The check transportation path 7 has a basically U-shaped configuration when seen from above, and is a narrow vertical channel that is open at the top. The vertical channel has opposing side walls and a bottom. The checks 6 are conveyed horizontally through the U-shaped transportation path while standing on edge on the bottom (transportation guide surface) of this vertical channel.

The upstream end in the transportation direction of the check transportation path 7 is connected through an upstream transportation path portion 8 that is a narrow vertical channel to a check storage unit 9, which is a wide vertical channel. The downstream end of the check transportation path 7 is connected to a check discharge unit 10.

The check discharge unit 10 has first and second branch paths 11 and 12 that are narrow vertical channels connected to the downstream end of the check transportation path 7, first and second storage pockets 13 and 14 that are connected to the downstream ends of the branch paths, and a flapper 15 (sorting unit) that directs discharging the check 6 to one of the storage pockets 13 and 14.

As shown in FIG. 1, a check 6 used as an example of the medium in this embodiment of the invention has a horizontally long, rectangular shape with an MICR line 6A printed along the long bottom edge on the front 6*a* of the check 6. Also recorded on the front 6*a* against a patterned background are the check amount, payer and payee, various numbers, and the payer signature. An endorsement is recorded on the back 6*b* of the check 6. The checks 6 are loaded in the check storage unit 9 with the tops and bottoms of the checks together and the fronts 6*a* facing the outside of the substantially U-shaped check transportation path 7.

The checks 6 are loaded in a stack into the check storage unit 9, and a check feeding mechanism that feeds the checks 6 one at a time through the check feed path 8 into the check transportation path 7 is assembled to the check storage unit 9. As indicated by the dotted lines in FIG. 2, the check feeding mechanism includes a pickup roller 16 that picks and delivers the checks 6 loaded in the check storage unit 9 into the check feed path 8, and a pressure member 17 that presses the checks 6 against the pickup roller 16. A separation mechanism including a separation pad 18 and a retard-roller type separation unit 19 is also provided for separating and feeding the checks 6 delivered to the check feed path 8 one at a time into the check transportation path 7.

As indicated by the dotted lines in FIG. 2, a front contact image sensor 21 for imaging the fronts 6*a* of the checks 6, a back contact image sensor 22 for imaging the backs 6*b* of the checks 6, a magnetic head 23 for reading the MICR line 6A, and a printing mechanism 24 for printing ELECTRONIC FUNDS TRANSFER, for example, on the check front 6*a* are disposed in this order along the check transportation path 7. A paper thickness detector 25 (first detector) that detects the thickness of the passing check 6 is disposed opposite the magnetic head 23. In this embodiment of the invention the paper thickness detector 25 is also described as having the function of a first detector at a first position.

An optical length detector 26 (second detector) is disposed to a position offset perpendicularly to the check transportation direction from the paper thickness detector 25, and in this embodiment of the invention is disposed to a separated position above the paper thickness detector 25.

The configuration of the paper thickness detector 25 is further described below.

The length detector 26 is, for example, a reflection type photosensor, and can use a linear semiconductor position detection device, for example, as the photoreceptor that detects the reflection from the check 6. The paper thickness detector 25 and length detector 26 are used to detect if the check 6 is conveyed skewed at an angle exceeding the allowable skew angle.

A transportation mechanism (not shown in the figure) conveys checks 6 along the check transportation path 7. The transportation mechanism can be configured using a transportation motor, a plurality of transportation rollers disposed along the check transportation path 7, and a drive belt for transferring torque from the motor to the transportation rollers.

As a check 6 that is fed from the check storage unit 9 through the check feed path 8 is conveyed along the check transportation path 7, images of the front and back of the check are captured, and the MICR line 6A printed on the front 6*a* is then read. If this information is captured normally from the check 6, ELECTRONIC FUNDS TRANSFER or other text is printed and the check 6 is directed to and stored in the first storage pocket 13 (first discharge unit). If the check 6 cannot be read or a read error occurs, the check 6 is directed to and stored in the second storage pocket 14 (second discharge unit) without being printed.

Figure 3:
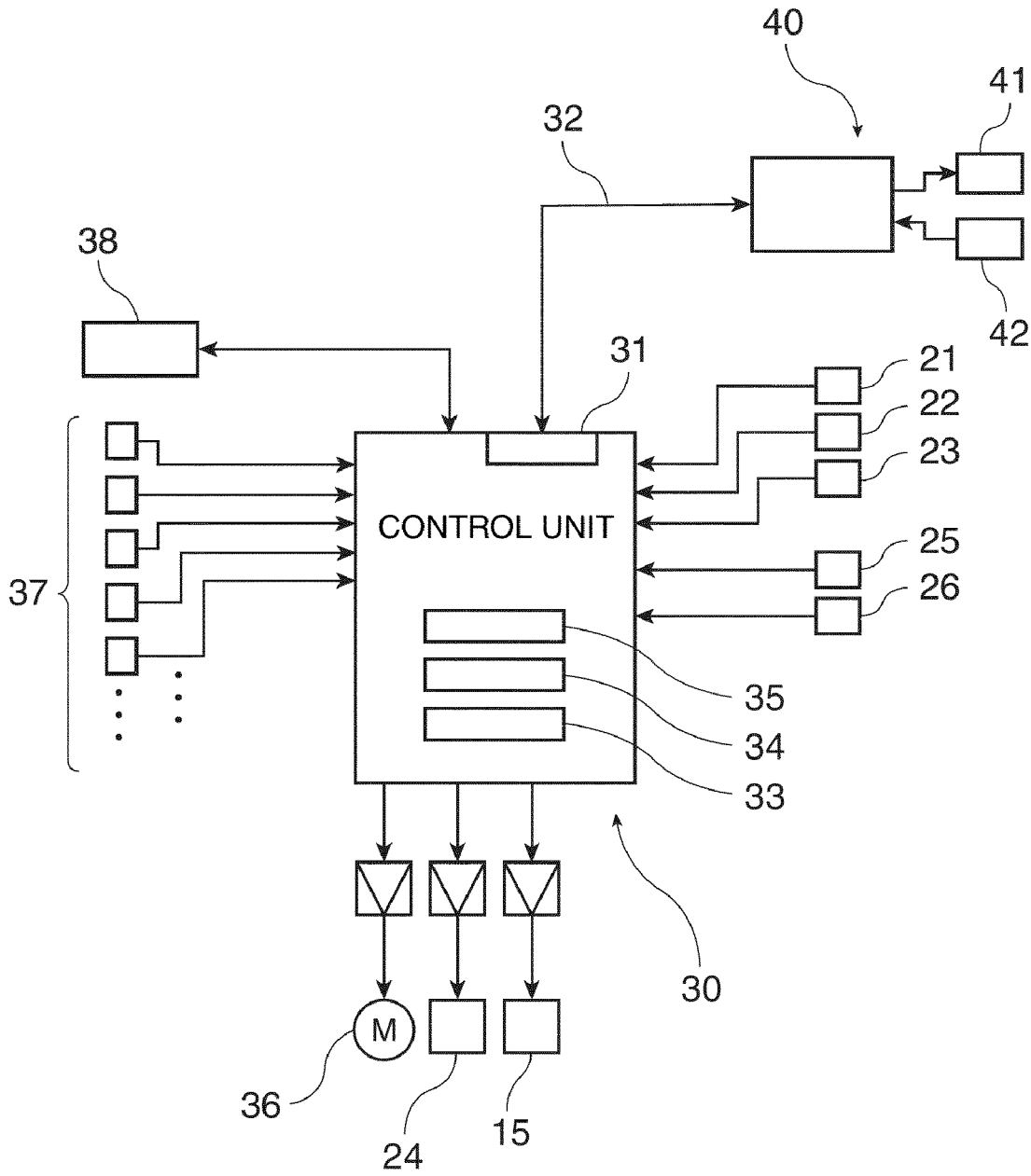
FIG. 3 is a function block diagram showing the control system of the check processing device in FIG. 1.

FIG. 3 is a block diagram describing the control system of the check processing device 1. The control system of the check processing device 1 includes memory such as ROM and RAM, and a control unit 30 built around a CPU. The control unit 30 is connected to a host computer 40 through a communication unit 31 and communication cable 32.

The host computer 40 has input/output devices such as a display device 41 and operating units 42 such as a keyboard and mouse, and commands such as a check reading operation start command are output from the host computer 40 to the control unit 30 of the check processing device 1.

The skewed feed detection unit 33 has a skewed feed detection unit 33 that determines if a check 6 is being conveyed in a skewed position at an angle exceeding the allowable skew angle relative to the normal transportation position in which the check 6 is not skewed based on the detection signals from the paper thickness detector 25 and length detector 26.

The control unit 30 also has a sorting control unit 34 that switches the flapper 15 from the position where it is held directing checks 6 into the first storage pocket 13 to discharge the check 6 into the second storage pocket 14 if it is determined from the skewed feed detection unit 33 that the check 6 is being conveyed in a skewed position.

The control unit 30 also has a read information processing unit 35 that invalidates the front image, the back image, and the information read from the MICR line of the check 6 if the skewed feed detection unit 33 detects that the check 6 is being conveyed in a skewed position. The read information processing unit 35 sends an invalidation command to invalidate the captured information through the communication unit 31 to the host computer 40. When this invalidation command is received, the host computer 40 does not execute the magnetic ink character recognition process, for example, because the data is invalid.

When the read operation start command is received, the control unit 30 drives the transportation motor 36 to convey a check, feeds a check 6 into the check transportation path 7, and conveys the fed check 6 through the check transportation path 7. The control unit 30 controls conveying the check 6 based on signals from a sensor group 37 of sensors disposed at plural positions along the check transportation path 7. A front image, back image, and the magnetic ink character data captured from the check 6 by the front contact image sensor 21, the back contact image sensor 22, and the magnetic head 23 are input to the control unit 30.

The captured information is sent to the host computer 40, the host computer 40 executes image processing and character recognition operations, determines if the information was read correctly, and returns the result of this decision to the control unit 30. Based on the received result, the control unit 30 controls driving the printing mechanism 24 and the flapper 15. Note that an operating unit 38 including operating switches such as a power switch disposed to the case 2 is connected to the control unit 30. Note, further, that the control unit 30 may be configured to execute the magnetic ink character recognition process, image processing and character recognition operations, and determine if the information was read correctly, instead of the host computer 40 performing these operations.

Check Processing Operation

Figure 4:
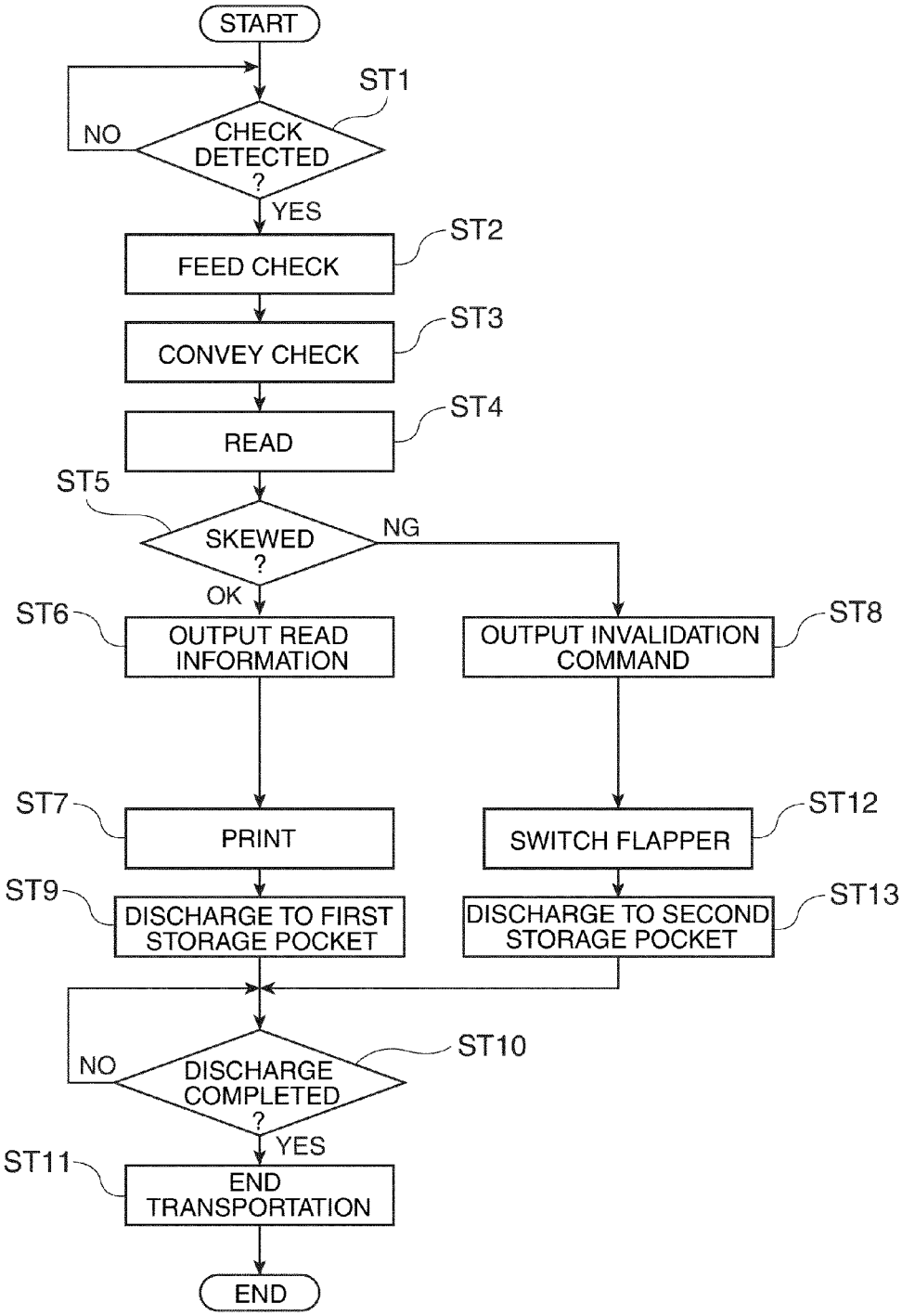
FIG. 4 is a flow chart describing the check processing operation of the check processing device shown in FIG. 1.

FIG. 4 is a flow chart describing the processing operation of the check processing device 1. When the user enters a start reading command from the operating unit 42 of the host computer 40, whether a check 6 is inserted to the check storage unit 9 is first detected (step ST1). If a check is inserted (step ST1 returns Yes), the check 6 is fed from the check storage unit 9 (step ST2) and the fed check 6 is conveyed through the check transportation path 7 (step ST3). An image of the front, an image of the back, and the MICR line are read from the conveyed check 6 by the front contact image sensor 21, back contact image sensor 22, and magnetic head 23, respectively, and the length of the conveyed check 6 in the transportation direction is detected based on the output of the paper thickness detector 25 and the length detector 26 as described below (step ST4).

The skewed feed detection unit 33 determines if the check 6 is in a skewed feed state from the check length detected based on the output of the paper thickness detector 25 and the length detector 26 (step ST5). If skewed feed is not detected (step ST5 returns OK), the captured information is sent through the communication unit 31 and communication cable 32 to the host computer 40 (step ST6).

If the check 6 is conveyed with the top and bottom reversed (upside down), a read error is returned because the magnetic ink characters cannot be read. This is because the MICR line 6A on the check 6 does not pass the position where the magnetic head 23 is located. A read error is also returned if the check 6 is conveyed with the front and back reversed because the magnetic ink character information cannot be acquired. A read error is also returned if the check 6 is folded or torn and a part of the magnetic ink character line cannot be read. A read error is also returned if the check amount and other specific information cannot be recognized from the front and back check images as a result of the check 6 being folded or torn.

If the control unit 30 of the check processing device 1 is configured to process the captured front image data, back image data, and magnetic ink character information and determine if the check was read normally, high speed processing is possible. If a read error occurs, an error is reported to the host computer 40 (reading can be evaluated and the result can be reported in step ST4). Whether the check was read normally or not may also be decided on the host computer 40 side instead of by the control unit 30. In this configuration the result of the read state determination by the host computer 40 is sent to the check processing device 1 and received by the control unit 30 thereof.

The skewed feed detection unit 33 determines on the check processing device 1 side whether or not the check 6 is conveyed in a skewed position, and if a skewed feed state is detected (step ST5 returns NG), the read information processing unit 35 generates and sends an invalidation command for invalidating the read information to the host computer 40 (step ST8). When an invalidation command is received on the host computer 40 side, the host computer 40 can present a prompt telling the user to check the check 6 discharged into the second storage pocket 14 described below, reinsert the check 6 to the check storage unit 9, and read the check 6 again.

Only if the skewed feed detection unit 33 decides that the check is not conveyed in a skewed position and it is determined that the check was read normally (step ST5 returns OK), the control unit 30 of the check processing device 1 prints ELECTRONIC FUNDS TRANSFER, for example, on the check 6 by means of the printing mechanism 24 (step ST7), and the printed check 6 is discharged by the flapper 15 to the first storage pocket 13 side (step ST9). When the check 6 is completely stored in the first storage pocket 13 (step ST10 returns Yes), the transportation operation stops (step ST11).

However, if skewed feeding of the check is detected by the skewed feed detection unit 33 (step ST5 returns NG), the flapper 15 is switched (step ST12). The printing mechanism 24 is also held in the standby position and does not print on the check 6. The check 6 is directed to the second storage pocket 14 by the flapper 15 and discharged thereinto (step ST13). When the check 6 is completely stored in the second storage pocket 14 (step ST10 returns Yes), the transportation operation stops (step ST11).

The same process executed when skewed feeding is detected may be executed when a read error is detected. In this situation the printing mechanism 24 does not print, and the flapper 15 is switched (step ST12). The check 6 is thus directed into the second storage pocket 14 by the flapper 15 and discharged thereinto (step ST13). When the check 6 is completely stored in the second storage pocket 14 (step ST10 returns Yes), the transportation operation stops (step ST11).

Skewed Feed Detection Mechanism

Figure 5:
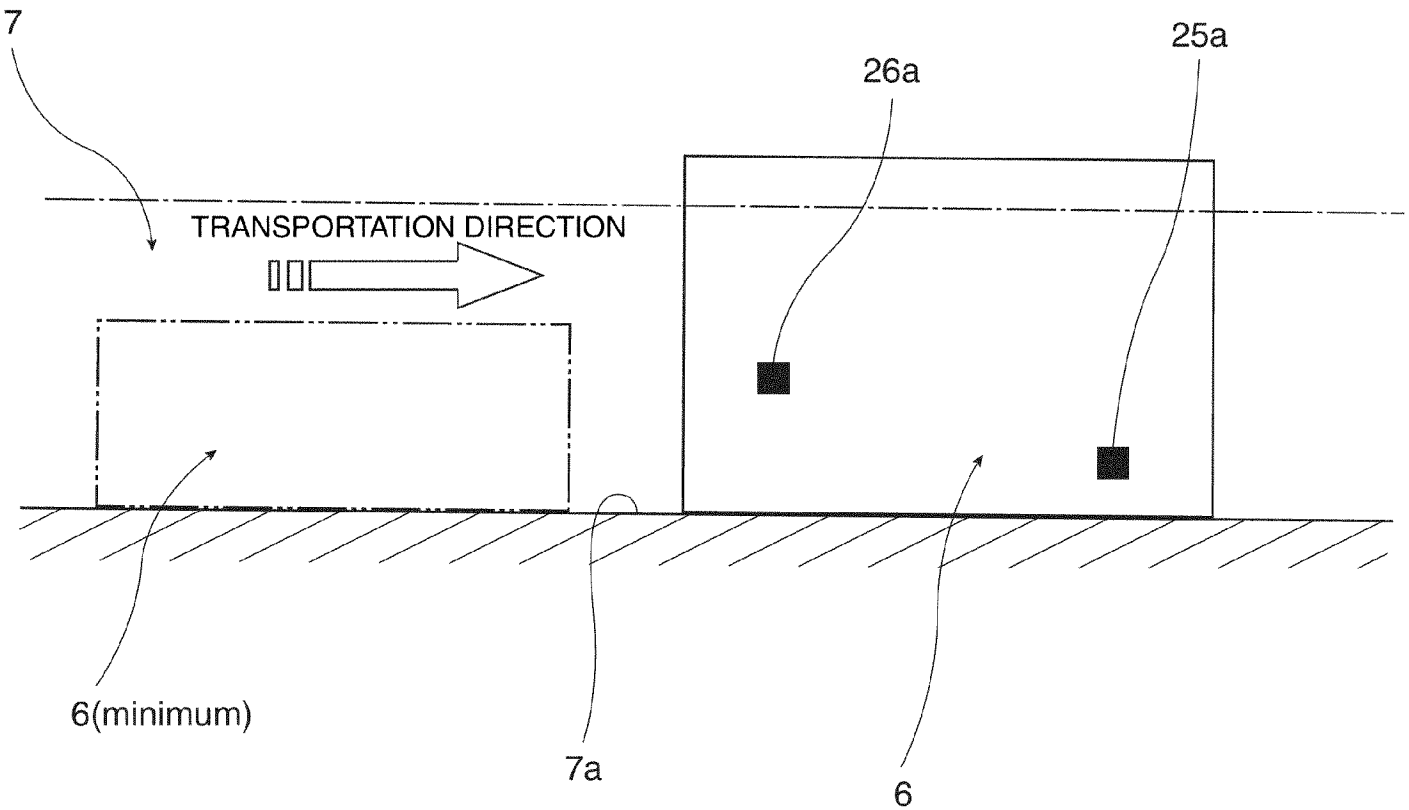
FIG. 5 shows the relative positions of the detectors in the check processing device shown in FIG. 1.

FIG. 5 describes the detection positions of the paper thickness detector 25 and length detector 26 used for skewed feed detection. A position opposite the magnetic head 23 of the check transportation path 7 is the detection position 25*a* of the paper thickness detector 25 (first position).

The detection position 26*a* of the length detector 26 (second position) is offset from the first detection position 25*a* to a position that is on the upstream side of the check transportation path 7 and is raised (in a direction perpendicular to the transportation direction) above the bottom of the transportation path (transportation guide surface 7*a*). The checks 6 may be of plural different sizes. The imaginary line in FIG. 5 represents a check 6 of the narrowest (minimum) width (height). The height of the length detector 26 from the transportation guide surface 7*a* is set to a position within the area through which the check 6 passes when a check 6 of the narrowest width (minimum size) as indicated by the imaginary line in the figure is conveyed through the check transportation path 7. Note that because the check transportation path 7 is a vertical channel that is open at the top, when a wide check 6 such as indicated by a solid line in the figure is conveyed, the top part of the check will protrude above the top of the check transportation path 7.

Figure 6A:
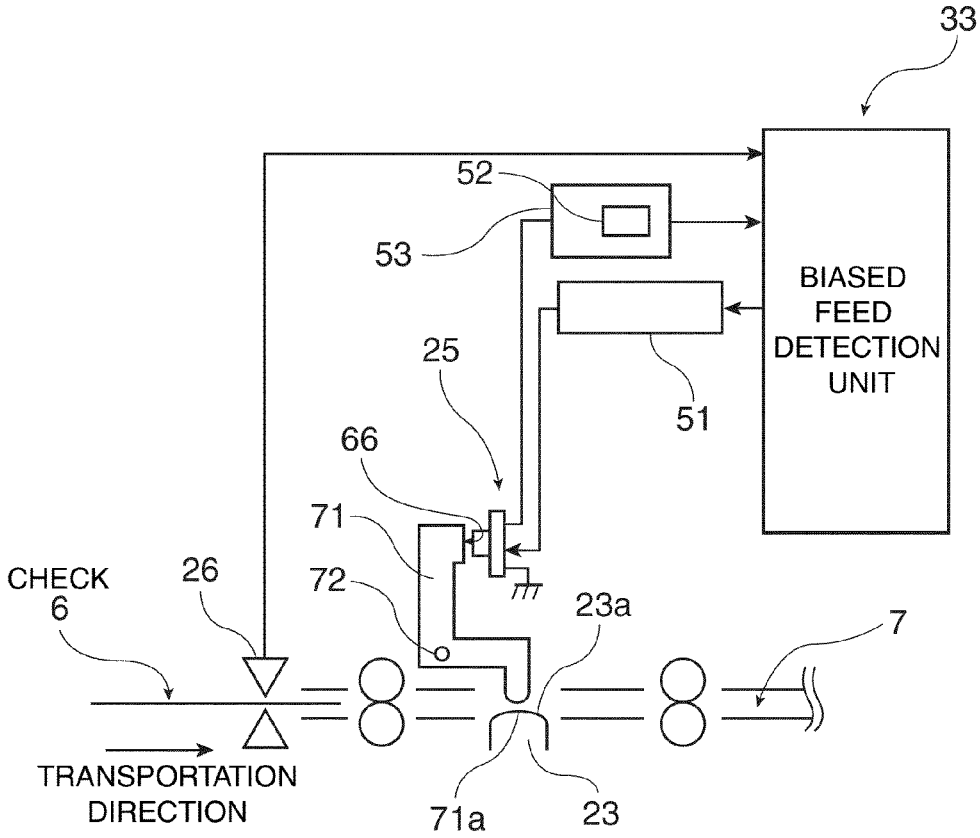
FIGS. 6A and 6B schematically describe the skewed feed detection part of the check processing device shown in FIG. 1.
Figure 6B:
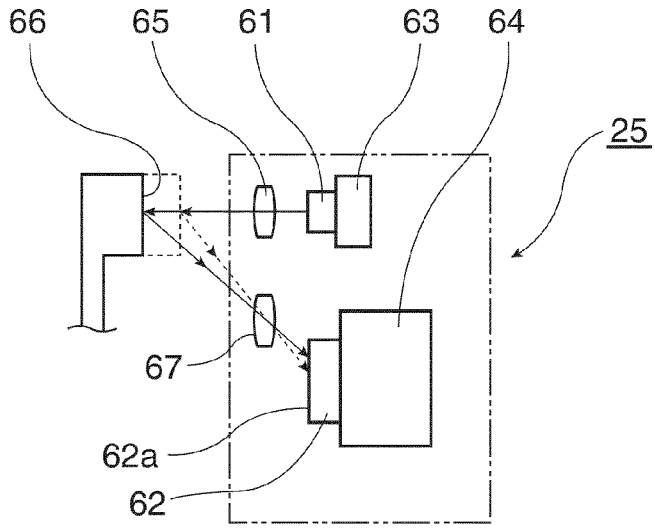

FIG. 6A and FIG. 6B schematically describes the skewed feed detection mechanism part. The skewed feed detection mechanism includes the paper thickness detector 25, the length detector 26, and the skewed feed detection unit 33 that determines skewed feeding of a check 6 based on the output of the paper thickness detector 25 and the length detector 26. In this aspect of the invention the paper thickness detector 25 also has the function of a length detector.

The skewed feed detection unit 33 supplies a drive pulse signal of a specific duty ratio and period through an optical pulse control circuit 51 to drive the paper thickness detector 25. The detection signal from the paper thickness detector 25 passes a signal processing circuit 53 including an A/D converter 52, is converted to a 10-bit digital signal, for example, and then supplied to the skewed feed detection unit 33. The skewed feed detection unit 33 reads the detection level of the paper thickness detector 25 at a constant sampling interval. The output from the length detector 26 is also A/D converted and supplied. Based on the read output from both detectors, the skewed feed detection unit 33 determines if the check 6 travelling through the check transportation path 7 is skewed or not.

As shown in FIG. 6B, the paper thickness detector 25 has an LED 61, linear semiconductor position detection device 62, LED drive circuit 63, and signal processing circuit 64. The detection beam from the LED 61 passes through a projection lens 65 onto the detection surface 66. The reflection from the detection surface passes through a photoreceptor lens 67, and converges on the photoreception surface 62*a* of the linear semiconductor position detection device 62. Voltages internally divided according to the photoreception position of the reflected beam are output from both ends of the linear semiconductor position detection device 62, and the photoreception position of the reflected beam is detected from the difference between these end potentials. The position of the detection surface 66 can then be detected from the photoreception position of the linear semiconductor position detection device 62.

This embodiment of the invention has a detection lever 71 for pressing the check 6 to the detection surface 23*a* of the magnetic head 23 for magnetic ink character reading in the check processing device 1. The detection surface 66 of the paper thickness detector 25 is formed on the base end of the detection lever 71. In other words, the detection position 25*a* is defined by the distal end surface 71*a* of the detection lever 71. The detection lever 71 pivots on pivot pin 72 according to the thickness of the check 6 that passes between the distal end surface 71*a* and the magnetic head 23. Because the distance from the pivot pin 72 to the detection surface 66 is longer than the distance from the pivot pin 72 to the distal end surface 71*a*, the displacement of the distal end surface 71*a* is amplified and relayed to the detection surface 66. The detection surface 66 is displaced toward or away from the paper thickness detector 25, and the position where the reflection is incident to the photoreception surface 62*a* of the linear semiconductor position detection device 62 moves according to the amount of displacement. Therefore, the thickness of the check 6 passign the magnetic head 23, which is the detection position of the paper thickness detector 25, can be known based on the detection signal from the linear semiconductor position detection device 62.

The check processing device 1 according to this embodiment of the invention uses a stepping motor (see FIG. 3) controlled by the control unit 30 as the transportation motor 36 for conveying checks. Based on the change in thickness detected by the paper thickness detector 25, the skewed feed detection unit 33 detects the length in the transportation direction of the conveyed check 6 based on the number of steps the stepping motor is driven between when the thickness changes to a specific thickness from substantially zero, which is the thickness when a check 6 is not present, and then returns to substantially zero again. If the check 6 is folded over, the folded length of the check 6 can also be detected based on the change in the thickness detected by the paper thickness detector 25. This is because when a part of the conveyed check 6 is folded over, the detected thickness of the folded part of the check 6 will be the thickness of two checks.

The skewed feed detection unit 33 can also detect the length of the conveyed check 6 in the transportation direction based on the number of steps the stepping motor is driven while the check 6 passes by the length detector 26. Skewed feeding of the check 6 can be detected based on the two detected check lengths and the length of the folded part.

Skewed Feed Detection

Figure 7:
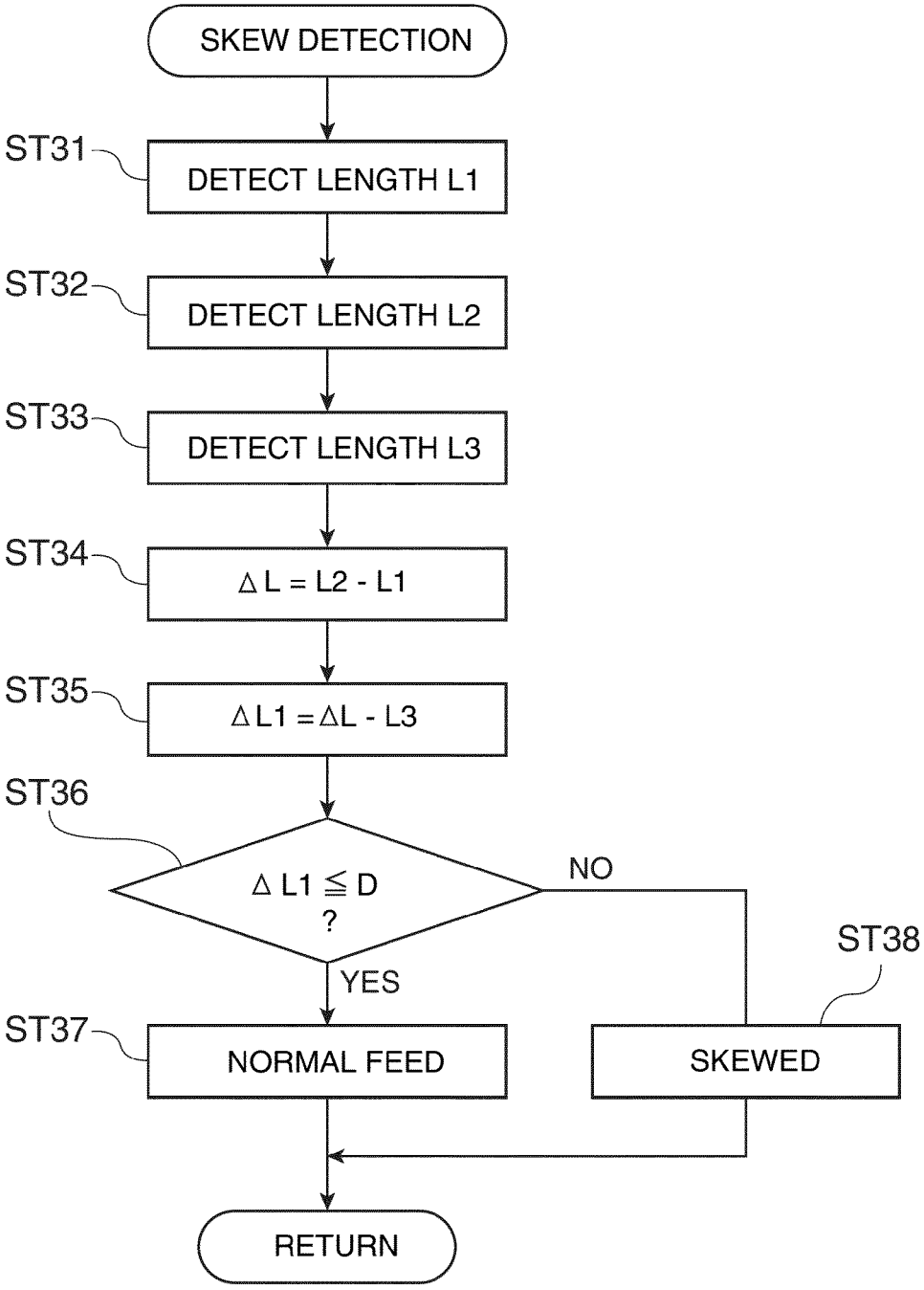
FIG. 7 is a flow chart describing the skewed feed detection operation of the check processing device shown in FIG. 1.

FIG. 7 is a flow chart describing the skewed feed detection operation, and FIG. 8 illustrates the skewed feed detection operation.

In the skewed feed detection operation the skewed feed detection unit 33 first detects, based on the detection signals output from the paper thickness detector 25 and length detector 26, the lengths L1 and L2 in the transportation direction of the part of the check 6 passing the respective detection positions, and detects the folded length L3 of the leading end of the check 6 (steps ST31, ST32, ST33 in FIG. 7). The detection signals of the paper thickness detector 25 and length detector 26 are output substantially simultaneously in conjunction with check 6 transportation. The difference ΔL (=L2−L1) between the detected length L1 from the paper thickness detector 25 and the detected length L2 from the length detector 26 is then calculated (step ST34 in FIG. 7).

Figure 8A:
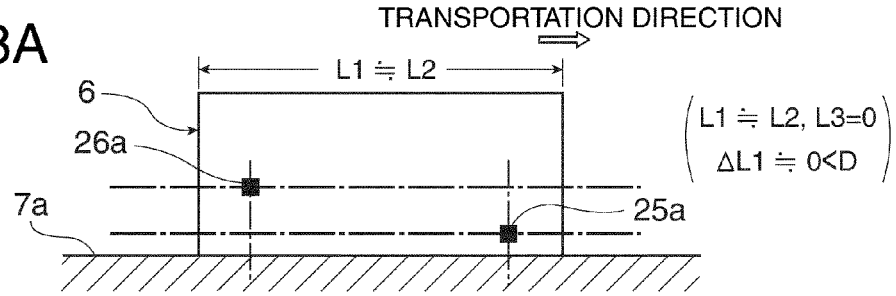
FIGS. 8A-8D describe the skewed feed detection operation shown in FIG. 7.

The checks 6 are rectangular and are conveyed along the bottom 7*a* (transportation guide surface) of the check transportation path 7. Therefore, if a check is conveyed normally and is not skewed (conveyed at an angle), the detected transportation length will be substantially the same at all detection positions in the direction perpendicular to the transportation direction, and the difference ΔL will in practice be substantially zero. If an allowable difference D corresponding to the allowable skew angle (skew angle) is set, and the difference ΔL is less than or equal to this threshold value D, it can be determined that the check 6 is being conveyed normally with no skew as shown in FIG. 8A. Therefore, if the difference ΔL is less than or equal to threshold value D, it can be determined that the check 6 is being conveyed normally with skew within the allowable skew angle.

Figure 8B:
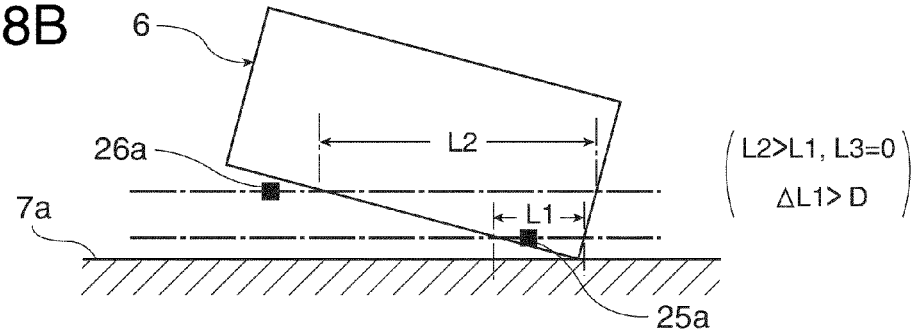

However, if difference ΔL exceeds threshold value D, the possibility of a skewed transportation state is high. As shown in FIG. 8B, when the check 6 is conveyed along the bottom 7*a* of the check transportation path 7 with skew exceeding the allowable skew angle, the detected length L1 output by the paper thickness detector 25 with its detection position 25*a* at the bottom of the check transportation path 7 will be shorter than the detected length L2 output by the length detector 26 with its detection position 26*a* at a higher position. A skewed feed state exceeding the allowable skew angle can therefore be detected if the difference ΔL is greater than threshold value D.

Figure 8C:
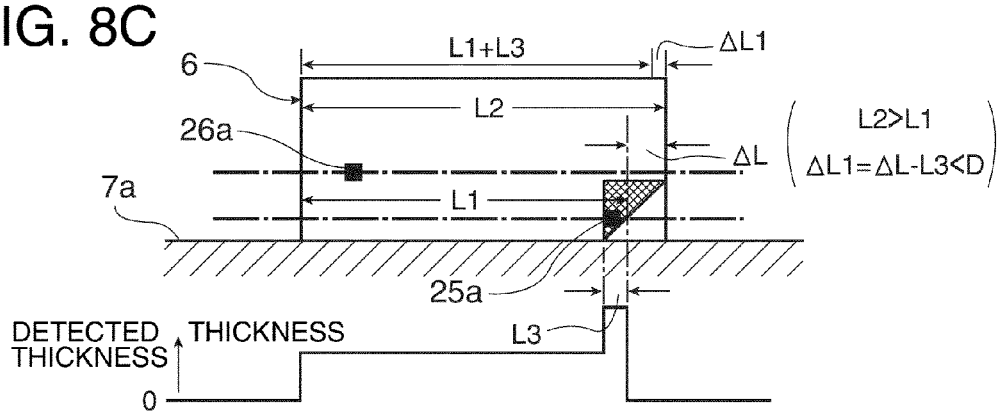

However, when the difference ΔL exceeds the threshold value D, it is also possible that there is a folded part at the leading end of the check 6 as shown in FIG. 8C. In this situation, the detected length L1 output from the paper thickness detector 25 will be shortened by the length of the folded portion, and the difference ΔL may exceed the threshold value D even though the check is conveyed in a normal, unskewed position. The problem in this situation is that skewed feeding may be erroneously detected even though the check is not in a skewed position.

In this embodiment of the invention, the skewed feed detection unit 33 therefore detects the folded length L3 based on the detection signal from the paper thickness detector 25 in step ST33 in FIG. 7. As shown in FIG. 8C, because the thickness of the part that is folded over is detected by the paper thickness detector 25 to be substantially twice the thickness of the other parts of the check 6, the skewed feed detection unit 33 calculates the folded length L3 by calculating the length of this portion with an increased thickness. The corrected difference ΔL1 is then obtained by subtracting this folded length L3 from the difference ΔL (step ST35 in FIG. 7).

When there is no folded part, the folded length L3 is substantially zero and the corrected difference ΔL1 will be substantially equal to the difference ΔL before correction.

This corrected difference ΔL1 is then compared with the threshold value D (step ST36 in FIG. 7). If corrected difference ΔL1 is less than or equal to threshold value D (step ST36 returns Yes), the lengths differ greatly as a result of the folded part as shown in FIG. 8C, and check 6 transportation is determined to be normal (step ST37 in FIG. 7). If the corrected difference ΔL1 exceeds the threshold value D (step ST36 returns No), a skewed feed state is detected (step ST38 in FIG. 7).

This embodiment of the invention can thus accurately detect skewed feeding of a check 6 when the check is not folded over as shown in FIG. 8A and FIG. 8B, and when the check is folded over as shown in FIG. 8C without being affected by the folded part.

Figure 8D:
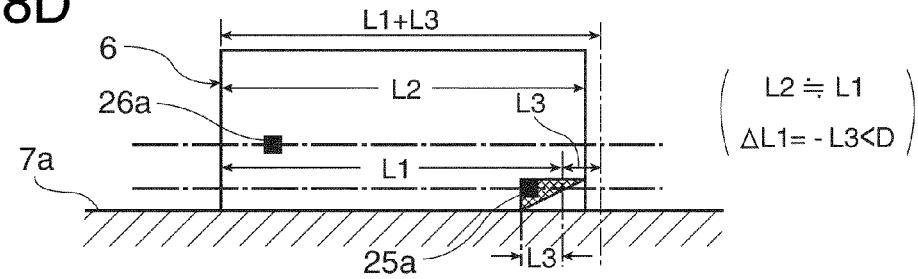

It is also conceivable as shown in FIG. 8D that the folded length L3 is long in the transportation direction at the part of the check 6 that passes over the detection position 25*a* of the paper thickness detector 25. In this situation the difference ΔL between detected lengths L1 and L2 will be substantially zero. Therefore, if the folded length L3 is subtracted from the difference ΔL1, the corrected difference ΔL1 will be a negative value and less than the threshold value D. A normal check transportation state can therefore be determined. Erroneously detecting a normal transportation condition to be a skewed transportation condition because there is a folded part can thus be prevented.

As described above, when the difference ΔL exceeds the threshold value D, this embodiment of the invention also considers the length L3 of a folded part to detect skewed feeding. Skewed feeding detection errors caused by folds in the conveyed medium can thus be greatly reduced, and skewed feeding can be accurately detected.

Other Embodiments

At least one embodiment of the invention described above relates particularly to a check processing device. The invention is not limited to check processing devices, however, and can be applied to any sheet medium transportation device that conveys sheet media one sheet at a time.

The preferred embodiment described above also has the skewed feed detection unit for determining skewed feeding of the check disposed on the check processing device side. Determination of skewed feeding can be done on the host computer side, however.

Furthermore, in addition to detecting skewed feeding, at least one embodiment of the invention described above may also detect check multifeeding, and conveyance of the medium with the top and bottom upside down or the front and back reversed, and may be configured to send a signal to the host computer side to invalidate the read information when such a medium transportation error is detected.

The embodiment described above has a paper thickness detector 25 and a length detector 26, but detectors identical to the paper thickness detector 25 can be used for both with both detectors detecting the length of any folded part. In this configuration if the difference ΔL exceeds the threshold value D, the folded length is added to both detected lengths L1 and L2 to calculate a corrected difference ΔL1, and skewed feeding can be detected based on this corrected difference ΔL1.

In addition, the paper thickness detector 25 also functions as a length detector, but a separate length detector may be provided.

At least one embodiment of invention having been thus described, it will be apparent to one skilled in the art based on the foregoing description, that the invention may be varied in many ways. Any such variation, to the extent that it falls within any of the following claims, is deemed to be within the scope of the invention.

What is claimed is:

1. A medium detection method, comprising steps of:

conveying a medium along a transportation path;

detecting, based on information obtained at a first position on the transportation path, a first length in a transportation direction of the medium passing the first position;

detecting, based on information obtained at a second position that is separated a specific distance from the first position on the transportation path, a second length in the transportation direction of the medium passing the second position;

detecting, based on information obtained at a third position on the transportation path, a thickness of the medium passing the third position, including detecting any substantial change in thickness of the medium as it is passes the third position;

calculating a third length in the transportation direction of the medium of the substantial change in thickness when it is detected;

calculating a corrected difference based on the first, second and third lengths when the substantial change in thickness is detected; and determining if the medium is being conveyed skewed to the transportation direction based on the corrected difference when the substantial change in thickness is detected.

2. The medium detection method described in claim 1, further comprising steps of:

calculating a difference between the first length and the second length;

calculating the corrected difference by subtracting the third length from the calculated difference; and determining that the medium is skewed to the transportation direction if the corrected difference exceeds a predetermined threshold value.

3. The medium detection method described in claim 1, further comprising steps of:

calculating a difference between the first length and the second length;

calculating the corrected difference by subtracting the third length from the calculated difference; and determining that the medium is not skewed to the transportation direction if the corrected difference is less than or equal to a predetermined threshold value.

4. The medium detection method described in claim 2, wherein:

the medium is determined to be conveyed skewed at an angle exceeding an allowable skew angle to the transportation direction if the corrected difference exceeds the threshold value.

5. The medium detection method described in claim 3, wherein the medium is determined to be at an angle less than or equal to an allowable skew angle to the transportation direction and the medium is not conveyed skewed if the corrected difference is less than or equal to the threshold value.

6. The medium detection method described in claim 1, wherein:

the transportation path includes a channel; and the first position is disposed to a position closer to a bottom of the channel than the second position.

7. The medium detection method described in claim 1, wherein, if the medium is determined to not be skewed while conveyed, the medium is discharged from the transportation path into a first discharge unit, and if the medium is determined to be skewed while conveyed, the medium is discharged from the transportation path into a second discharge unit.

8. The medium detection method described in claim 1, wherein the third position and either one of the first position and the second position are substantially the same position.

9. A medium processing device, comprising:

a transportation path for conveying media;

a first detector and a second detector that detect first and second lengths respectively in a transportation direction of the medium, and are disposed to positions that are mutually separated a specific distance on the transportation path;

a thickness detector disposed to the transportation path that detects any substantial change in thickness of the medium as it passes the thickness detector, and that detects a third length in the transportation direction of the medium of the substantial change in thickness when it is detected; and a control unit that calculates a corrected difference based on the results from the first, second and third detectors when the substantial change in thickness is detected and determines if the medium is conveyed skewed to the transportation direction based on the corrected difference when the substantial change in thickness is detected.

10. The medium processing device described in claim 9, wherein:

the control unit calculates a difference between the first length and the second length, calculates the third length of the medium based the detection result of the thickness detector, calculates the corrected difference by subtracting the third length from the calculated difference, and determines that the medium is skewed to the transportation direction if the corrected difference exceeds a predetermined threshold value.

11. The medium processing device described in claim 9, wherein:

the control unit calculates a difference between the first length and the second length, calculates the third length of the medium based on change in the detected thickness detected by the thickness detector, calculates the corrected difference by subtracting the third length from the calculated difference, and determines that the medium is not skewed to the transportation direction if the corrected difference is less than or equal to a predetermined threshold value.

12. The medium processing device described in claim 10, wherein:

the control unit determines that the medium is conveyed skewed at an angle exceeding an allowable skew angle to the transportation direction if the corrected difference exceeds the threshold value.

13. The medium processing device described in claim 11, wherein:

the control unit determines that the medium is at an angle less than or equal to an allowable skew angle to the transportation direction and the medium is not conveyed skewed if the corrected difference is less than or equal to the threshold value.

14. The medium processing device described in claim 9, wherein:

the transportation path includes a channel; and the first detector is disposed to a position closer to a bottom of the channel than the detection position of the second detector.

15. The medium processing device described in claim 9, further comprising:

a first discharge unit and a second discharge unit in which media are discharged at the downstream side of the transportation path; and a sorting unit that switches so that the medium is discharged into the first discharge unit when the control unit determines that the medium is not skewed, and the medium is discharged into the second discharge unit when the control unit determines that the medium is skewed.

16. The medium processing device described in claim 9, wherein either the first detector or the second detector also functions as a thickness detector.

17. The medium processing device described in claim 9, wherein:

a reading device that reads information from media is disposed to the transportation path; and the thickness detector has a detection lever that is pressed to the reading device with the medium therebetween and moves in a direction toward or away from the reading device according to the thickness of the intervening medium, and a detector that detects movement of the detection lever.

* * * * *